US007980736B2

(12) United States Patent
Soderman et al.

(10) Patent No.: US 7,980,736 B2
(45) Date of Patent: Jul. 19, 2011

(54) LIGHT FIXTURE ASSEMBLY HAVING IMPROVED HEAT DISSIPATION CAPABILITIES

(75) Inventors: Daryl Soderman, Fort Lauderdale, FL (US); Dale B. Stepps, Mountain Ranch, CA (US)

(73) Assignee: Inteltech Corporation, Fort Lauderdale, FL (US)

( * ) Notice: Subject to any disclaimer, the term of this patent is extended or adjusted under 35 U.S.C. 154(b) by 0 days.

(21) Appl. No.: 11/985,056

(22) Filed: Nov. 13, 2007

(65) Prior Publication Data

US 2009/0122553 A1 May 14, 2009

(51) Int. Cl.
*F21V 29/00* (2006.01)

(52) U.S. Cl. ..... 362/373; 362/249.02; 362/294

(58) Field of Classification Search ..... 362/249.01, 362/249.02, 145, 404, 373, 294
See application file for complete search history.

(56) References Cited

U.S. PATENT DOCUMENTS

| | | | | |
|---|---|---|---|---|
| 5,738,436 | A * | 4/1998 | Cummings et al. | 362/294 |
| 6,375,338 | B1 | 4/2002 | Cummings et al. | |
| 6,388,388 | B1 | 5/2002 | Weindorf et al. | |
| 6,472,828 | B1 | 10/2002 | Pruett et al. | |
| 6,642,674 | B2 | 11/2003 | Liao et al. | |
| 7,183,727 | B2 | 2/2007 | Ferguson et al. | |
| 7,186,000 | B2 | 3/2007 | Lebens et al. | |
| 7,252,385 | B2 | 8/2007 | Engle et al. | |
| 7,722,227 | B2 * | 5/2010 | Zhang et al. | 362/364 |
| 2005/0213047 | A1 | 9/2005 | Slobodin et al. | |
| 2007/0139923 | A1 | 6/2007 | Negley et al. | |
| 2007/0223230 | A1 | 9/2007 | Trojanowski et al. | |
| 2007/0242461 | A1 | 10/2007 | Reisenauer et al. | |
| 2009/0109052 | A1 | 4/2009 | Stepps et al. | |

FOREIGN PATENT DOCUMENTS

| | | | |
|---|---|---|---|
| WO | WO 2009/064433 | A1 | 5/2009 |
| WO | WO 2009/064434 | A1 | 5/2009 |

* cited by examiner

*Primary Examiner* — John A Ward
(74) *Attorney, Agent, or Firm* — Malloy & Malloy, P.A.

(57) ABSTRACT

A light fixture assembly including an illumination assembly in the form of one or more light emitting diodes is interconnected to an electrical energy source by control circuitry. A mounting assembly supports the illumination assembly and a cover structure is disposed in heat transferring relation to the mounting assembly, wherein both the mounting assembly and the cover structure are formed of conductive material, thereby effectively dissipating the heat generated by the LED illumination assembly. The illumination assembly is connected to a source and electric energy by a conductor assembly comprising one or more conductive material connectors mechanically interconnecting components of the light fixture into an assembled orientation. A non-conductive insulation assembly isolates each of the one or more conductive connectors from the mounting assembly to avoid electrical contact there between.

22 Claims, 6 Drawing Sheets

LIGHT FIXTURE ASSEMBLY HAVING IMPROVED HEAT DISSIPATION CAPABILITIES

BACKGROUND OF THE INVENTION

1. Field of the Invention

This invention is directed to a light fixture assembly comprising an illumination assembly incorporating a light emitting diode (LED) array electrically connected to a source of electrical energy by a conductor assembly segregated from conductive transfer to a heat sink portion of the light fixture. The heat sink is at least partially defined by a mounting assembly disposed in heat transferring engagement with the illumination assembly and in confronting, heat transferring engagement to a cover portion of the light fixture. The cover structure may include decorative characteristics which enhance the appearance of the light fixture while facilitating the dissipation of excessive heat therefrom.

2. Description of the Related Art

Various types of illumination assemblies which incorporate light emitting diodes (LED) as the light generating component have become increasingly popular in recent years. Such an increase in popularity is due, at least in part, to their overall efficiency as well as the ability to define various lighting arrays readily adaptable to numerous practical installations or applications.

Accordingly, LEDs are known for use in high power applications such as spotlights, automotive headlights, etc. However, due to their recognized versatility LEDs are also utilized extensively in various types of luminaires and/or like fixtures installed in conventional domestic and commercial environments. Such applications allow for the illumination of a given area in an efficient and variably decorative manner in that associated light fixtures may take the form of standard or customized lighting arrays, wall or ceiling mounted fixtures, inset lighting, etc. Further, LEDs provide increased energy efficiency and effective illumination output from the various types of light fixtures installed, while reducing maintenance costs associated therewith.

Therefore, the use of illumination assemblies incorporating collective LED arrays offer significant advantages in terms of increased lighting and efficiency of operation. However, certain disadvantages and problems associated with the use of LED based illumination assemblies are commonly recognized. More specifically, a primary concern with the structuring and use of LED illumination assemblies is the management or dissipation of excessive heat generated by the LED array. More specifically, the light intensity generated by an LED light source is generally a proportional function of its operational temperature. As such, LED illumination assemblies tend to generate a significant amount of heat during their operation, which in turn may derogatorily affect the light generated by the LED array as well as reduce the reliability and operational life thereof. Accordingly, the operable life of many LED based illumination assemblies may be significantly reduced due to premature failure of one or more light emitting diodes associated with a light fixture or other device.

Therefore, it is commonly recognized in the lighting industry that heat management and more specifically, heat dissipation is a critical structural and operational consideration in the manufacture, use, installation and overall viability of illumination assemblies incorporating light emitting diodes as the primary or exclusive light generating structure. Known attempts to overcome the problems associated with the generation of excessive heat involve the creation of diverse heat dissipating structures. By way of example, printed circuit boards have been disposed in a multi-layered or stacked array in attempt to transfer heat away from the LED array. Alternatively, one or more printed circuit boards associated with the operational control of the LED light generating structures include a metal core disposed and structured to further effect heat dissipation.

Other known or conventionally proposed solutions to the heat management problem include the utilization of a heat absorber including a heat conductive resin disposed in communicating relation with the circuitry of the LED array. Also, heat absorbing structures may be utilized which have a large physical configuration such as, but not limited to, a multi-finned structure providing a conductive path of heat transfer towards an area of dissipation. However, many known attempts do not effectively accomplish optimal heat transfer, resulting in lower operational performance and a reduced operational life as generally set forth above.

Accordingly, there is a long recognized need in the lighting industry for an efficient and practical heat dissipation assembly preferably of the type which may be easily included in the structure of a light fixture. Such a proposed assembly would allow the light fixture to assume any number of design configurations best suited to a specific application which is structured to effectively dissipate heat. As such, an LED based light assembly would be capable of an optimal level of light generation, while at the same time enjoying an extended operational life. Also, such an improved proposed light fixture should also include structural components which serve to effectively isolate or segregate the conductive material components associated with heat dissipation from direct contact with any type of electrical conductor.

Therefore, the proposed light fixture assembly would accomplish effective heat dissipation from a LED based illumination assembly, while at the same time assuring operational safety. Further, the proposed light fixture would be capable of sufficient structural and operational versatility to permit the light fixture to assume any of a variety of utilitarian and aesthetic configurations.

SUMMARY OF THE INVENTION

The present invention is directed a light fixture assembly structured to include efficient heat dissipating capabilities and effective isolation of the conductive material components associated with the heat dissipating capabilities, from electrical components which serve to interconnect an illumination assembly with a source of electrical energy. Accordingly, the light fixture assembly of the present invention may be utilized for a variety of practical applications including installations within commercial, domestic, and specialized environments.

More specifically, the light fixture assembly of the present invention includes an illumination assembly including a light generating structure in the form of a light emitting diode (LED) array. As such, the light generating structure can comprise at least one or alternatively a plurality of LEDs. Moreover, each of the one or more LEDs is operatively interconnected to control circuitry which serves to regulate the operation and activation thereof. In at least one preferred embodiment of the present invention, the control circuitry is in the form of a printed circuit structure electrically interconnected to the one or more LEDs. Further, the light fixture assembly of the present invention includes a conductor assembly disposed in interconnecting, current conducting relation between the illumination assembly and an appropriate source of electrical energy, as generally set forth above.

As is well known in the lighting industry, particularly in the category of LED based light generating structures, thermal management and more specifically, the dissipation of excessive heat generated from the LED array is a primary consideration. Adequate heat dissipation allows for optimal operative efficiency of the LED array as well as facilitating a long, operable life thereof. Accordingly, the light fixture assembly of the present invention accomplishes effective heat dissipation utilizing light fixture components which serve the normal structural, operational and decorative purpose of the light fixture assembly, while transferring heat from the illumination assembly to the surrounding environment.

Concurrently, the aforementioned components of the light fixture may enhance the overall decorative or aesthetic appearance of the light fixture assembly while being dimensioned and configured to adapt the installation of the light fixture assembly to any of a variety of locations. As such, the light fixture assembly of the present invention includes a mounting assembly connected in supporting engagement with the illumination assembly. The mounting assembly is formed of a conductive material and is disposed and structured to dissipate heat directly from the illumination assembly. The conductive material of the mounting assembly may be a metallic material and is accordingly both capable of efficient heat transfer as well as being electrically conductive.

In order to maintain the mounting assembly within predetermined or preferred dimensional or other structural parameters, the light fixture assembly of the present invention also includes a cover structure. The cover structure serves to at least partially cover the mounting assembly in a manner which provides for effective channeling or directing of light generated by the one or more LEDs outwardly from the cover structure, so as to properly illuminate the proximal area. However, one feature of the present invention is the cover structure also being formed of a heat conductive material such as, but not limited to, a metallic material similar to or different from the conductive material from which the mounting assembly is formed. In addition, the cover structure is operatively disposed, when in an assembled orientation, in direct confronting and/or mating engagement with the mounting assembly. It is therefore emphasized that the cover structure and mounting assembly define at least a portion of a heat sink and a path of thermal flow along which excessive heat may travel so as to be dissipated into the surrounding area.

In at least one preferred embodiment of the present invention, the cover assembly has a larger transverse and substantially overall dimension than that of the mounting assembly in order to provide structural and decorative versatility to the formation of the light fixture assembly. In addition, the larger dimensioning as well as the cooperative configuring of the cover assembly further facilitates an efficient dissipation of an adequate amount of heat from the LED array of the illumination assembly, such that the illumination assembly may be operated under optimal conditions without excessive heat build-up.

In order to further facilitate the transfer of heat to the surrounding environment, correspondingly disposed surfaces of the mounting assembly and the cover structure are disposed in continuous confronting engagement with one another over substantially all or at least a majority of the corresponding surface area of the mounting assembly. As set forth above, the dimension and configuration of the cover structure is such as to extend substantially outward from the peripheral boundaries of the mounting assembly. Therefore, the confronting surface of the cover structure is large enough to engage and cover preferably all but at least a majority of the surface area of the corresponding surface of the mounting assembly. In doing so, the mounting assembly will be able to maintain a smaller dimension and configuration while the larger cover structure facilitates efficient heat dissipation concurrently to enhancing preferred decorative, structural and/or operational features to the light fixture assembly.

Other structural and operative features which further facilitate effective heat dissipation from the illumination assembly is the cooperative and corresponding configuration of the confronting surfaces of both the cover structure and the mounting assembly. As such, the corresponding engaging surfaces of these two components may have what may be accurately referred to as a "stepped configuration". Such a stepped configuration facilitates a "mating relation" between the engaging surfaces of the mounting assembly and cover structure thereby further defining the aforementioned continuously engaging orientation of these corresponding surfaces. The transfer from the illumination assembly to the mounting assembly and from the mounting assembly to the cover structure is thereby apparently rendered more efficient due to such the continuous confronting engagement between the correspondingly disposed surfaces. Further, the enlarged dimension and configuration of the cover structure relative to that of the mounting assembly further enhances the efficiency of the heat transfer and dissipation procedure as should be apparent. Therefore, when in an assembled orientation, to be described in greater detail hereinafter, the mechanically interconnected illumination assembly, mounting assembly and cover structure define an effective and efficient heat sink capable of being incorporated in a light fixture assembly in a manner which enables its use in any of a variety of applications and installations for purposes of illuminating the surrounding environment.

As set forth above, the illumination assembly includes electrical control circuitry preferably in the form of a printed circuit structure which serves to regulate operation and current flow to the light generating structure in the form of an LED array. The illumination assembly is connected to an appropriate source of electrical energy by a conductor assembly associated with at least one or more preferred embodiments of the light fixture assembly of the present invention. The conductor assembly is disposed in interconnecting, current conducting relation between the illumination assembly and the aforementioned appropriate source of electrical energy. Further, the conductor assembly is incorporated within the overall structural and operational design of the light fixture assembly so as to maintain the intended features thereof while not interfering with the heat dissipating capabilities associated therewith.

Accordingly, the conductor assembly is preferably in the form of at least one but more practically a plurality of connectors, which are formed of a conductive material. Therefore, the one or more conductive material conductors not only channel electrical current flow from the source of electrical energy to the illumination assembly, but also mechanically interconnect specific structural components of the fixture assembly into an assembled orientation. Such assembled orientation comprises or is at least partially defined by the illumination assembly being disposed in confronting engagement and heat transferring relation to the mounting assembly and the mounting assembly disposed in continuous, heat transferring engagement with the cover structure. Accordingly, path of heat flow extends from the illumination assembly to the cover structure as set forth above. However, due to the fact, that the one or more connectors are structured to direct electric current flow to the illumination assembly, contact with the conductive material mounting assembly must be avoided.

Therefore, the connectors of the conductor assembly mechanically interconnect the illumination assembly and the mounting assembly in the aforementioned assembled orientation. In doing so, the one or more connectors pass through the mounting assembly so as to accomplish the mechanical interconnection resulting in this assembled orientation. In order to avoid conductive interference between the one or more connectors and the conductive material of the mounting assembly, the light fixture assembly of the present invention also includes an insulation assembly. The insulation assembly is formed of a non-conductive material and is disposed in isolating or segregating relation between the mounting assembly and each of the one or more connectors used to accomplish the assembled orientation of these components.

Further, at least one preferred embodiment of the insulation assembly comprises one or more non-conductive material bushings, equal in number to the number of connectors utilized to interconnect the mounting assembly and the illumination assembly. Each of the one or more bushings is disposed in surrounding relation to a different one of the one or more connectors and is appropriately mounted on or connected to the mounting assembly in a manner which isolates correspondingly positioned portions of the one or more connectors from the mounting assembly in order to prevent contact therebetween.

Therefore, the light fixture assembly of the present invention overcomes the disadvantages and problems associated with light assemblies incorporating an LED array, wherein excessive heat is generated. As such, the one or more preferred embodiments of the present invention serve to effectively dissipate excessive heat generated by an associated illumination assembly and further serve to isolate the various conductive material components of the heat sink from electrical components or the conductor assembly utilized to interconnect the illumination assembly to an appropriate source of electrical energy.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
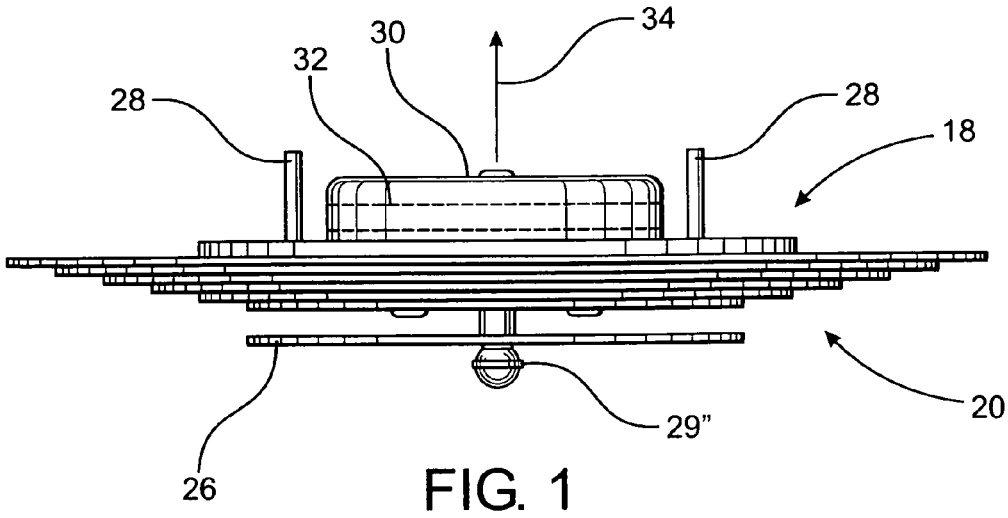
FIG. 1 is a side view of a preferred embodiment of a light fixture assembly of the present invention in an assembled form.
Figure 2:
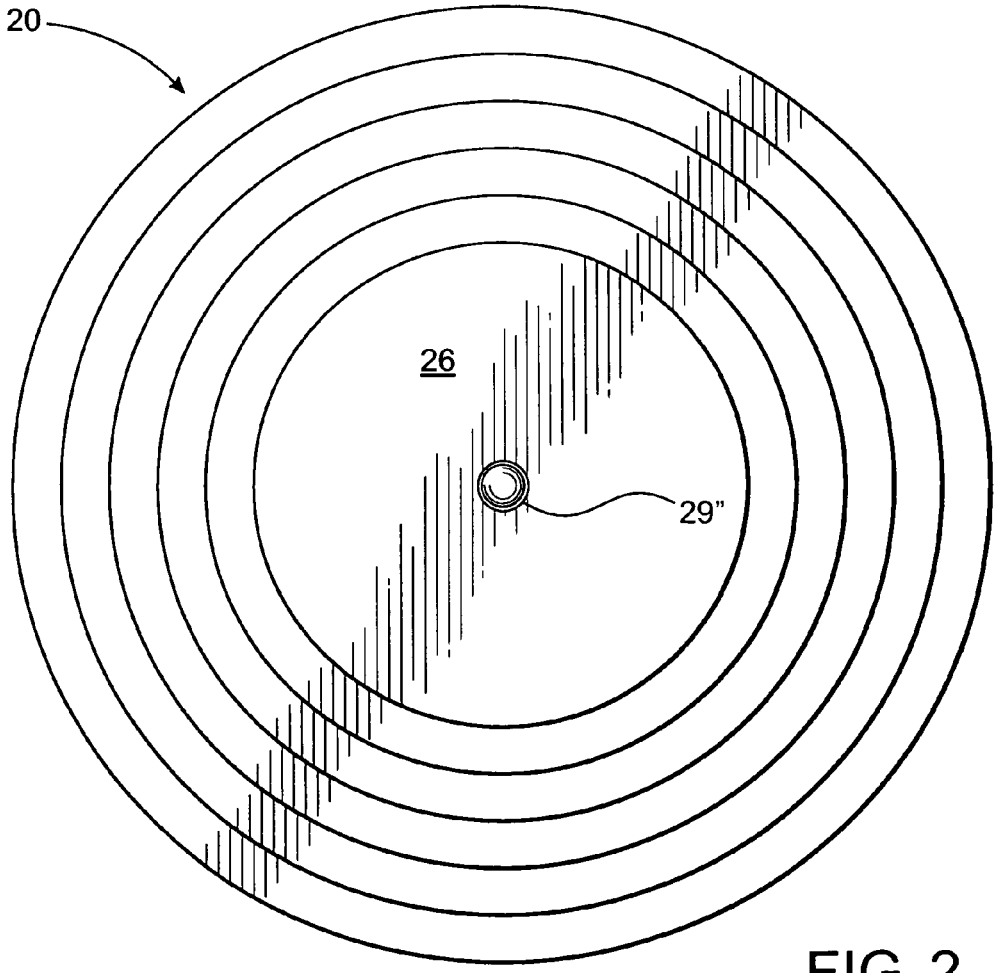
FIG. 2 is a bottom view of the preferred embodiment of FIG. 1.

As shown in the accompanying drawings, the present invention is directed to a light fixture generally indicated as 10. The light fixture 10 is of the type which may be installed in any of a variety of commercial, domestic or other sites and is decorative as well as functional to effectively illuminate a given area or space in the vicinity of the installed location. More specifically, and with reference primarily to FIGS. 1 through 6, the light fixture assembly 10 includes an illumination assembly generally indicated as 12 comprising one or more light emitting diodes 14 connected to electrical control circuitry 16. The control circuitry 16 is preferably in the form of a printed circuit structure 16' or printed circuit board having the various electrical or circuitry components integrated therein.

In addition, the light fixture assembly 10 includes a mounting assembly generally indicated as 18 and preferably, but not necessarily, comprising a plate or disk like configuration as also represented. It is emphasized that the specific structural configuration and dimension of the mounting assembly 18 may vary from that other than the represented plate or disk like shape. However, the mounting assembly 18 is connected in supporting relation to the illumination assembly 12 such that the control circuitry 16, is disposed in direct confronting and heat transferring engagement with a corresponding portion of the mounting assembly 18 as clearly represented in FIGS. 5 and 8 through 10. Additional structural features of the mounting assembly 18 include its formation from a conductive material. As such, the mounting assembly 18 may be formed from a metallic or other material which facilitates the conductivity or transfer of heat. As expected and discussed in greater detail hereinafter, the conductive material of the mounting assembly 18 will also be typically be electrically conductive. Such confronting engagement between the illumination assembly 12 and the mounting assembly 18 serves to adequately support and position the illumination assembly 12 in its intended orientation substantially co-axial to the mounting assembly 18 and also facilitates the transfer and dissipation of heat from the illumination assembly to and throughout the mounting assembly 18.

In order to enhance and render most efficient, the heat dissipating capabilities of the light fixture assembly 10, it further includes a cover structure generally indicated as 20 connected directly to the mounting assembly 18. More specifically, the cover structure 20 is also formed of a conductive material and as such is capable of heat transfer throughout its structure. In at least one preferred embodiment, the cover structure 20 is formed of a heat conductive material which may be a metallic material which is also capable of being electrically conductive. Therefore, efficient heat transfer from the illumination assembly 12 to the mounting assembly 18 and therefrom to the cover structure 20 is facilitated by the continuous confronting engagement of correspondingly positioned surfaces 18' and 20' respectively.

Heat dissipation is further facilitated by the structuring of the cover structure 20 to have an overall larger dimension than that of the mounting assembly 18. As such, the relatively unexposed surface 20' of the cover structure 20 is disposed in substantially continuous confronting engagement with the correspondingly disposed surface 18' to facilitate heat transfer through the mounting assembly 18 and the cover structure 20 when interconnected into the assembled orientation of FIGS. 1 through 3. Further, the correspondingly positioned surfaces 18' and 20' may also be correspondingly configured to further facilitate the continuous confronting engagement therebetween by establishing a mating relation as best demonstrated in FIG. 3.

Therefore, the corresponding configurations of the surfaces 18' and 20' may, in at least one preferred embodiment, be defined by a substantially "stepped configuration". Such a stepped configuration includes each of the confronting surfaces 18' and 20' having a plurality of substantially annular steps, as represented throughout FIGS. 1 through 10. More specifically, with reference to FIGS. 5 and 6, the mounting assembly 18 includes a plurality of annularly shaped steps 18" which collectively define the confronting surface 18' disposed in continuous engagement with the under surface or relatively unexposed surface 20' of the cover structure 20. The stepped configuration of the surface 20' of the cover structure 20 is clearly represented in FIG. 3 as is the mating relation or engagement between the annular steps 20" and 18" as indicated. As should also be noted, the plurality of annular steps 20" continue on the exposed or outer surface of the cover structure 20 in order to provide a more decorative or aesthetic appearance.

In addition, due to the fact that the cover structure 20 extends outwardly a significantly greater distance from the mounting assembly 18, a continuous confronting engagement between the corresponding surfaces 18' and 20' is such as to extend over substantially all or at least a majority of the surface area of the corresponding surface 18' of at least the cover structure 18. The enlarged dimension and the overall configuration of the cover structure 20, extending outward and in somewhat surrounding relation to the peripheral boundaries of the cover structure 18' further facilitates the dissipation of heat being transferred from the illumination assembly 12. More specifically and as should be apparent, the heat being removed from the illumination assembly 12 is transferred there from, through the mounting assembly 18 and continuously through the cover structure 20. From the cover structure 20, the heat is dissipated to the surrounding environment.

Cooperative structural features of the illumination assembly 12, the mounting assembly 18, and the cover structure 20 include an apertured construction comprising the provision of an aperture or opening 24 in a center or other appropriate portion of the cover structure 20. The opening 24 is disposed, dimensioned and configured to receive the illumination assembly 12 therein or at least be in alignment therewith. As such, the light generated by the one or more light emitting diodes 14 passes through the opening 24 so as to be directed or channeled outwardly from the exposed or outermost surface of the cover assembly 20. The surrounding area is thereby effectively illuminated.

Additional structural features associated with the directing or channeling of light from the illumination assembly 12 through the opening 24 include a light shield 26 which may be formed of a transparent and/or translucent material such as glass, plastic, etc. The light shield 26 may be structured to further direct or channel, in a more efficient manner, the illumination generated by the LEDs 14 of the illumination assembly 12. Accordingly, the light shield 26 is disposed in overlying or underlying, as represented in the orientation of the assembly 10 in the accompanying Figures, but spaced relation to the opening 24 and to the illumination assembly 12 when the various components of the light fixture assembly 10 are in an assembled orientation as represented in FIGS. 3 and 4.

Figure 3:
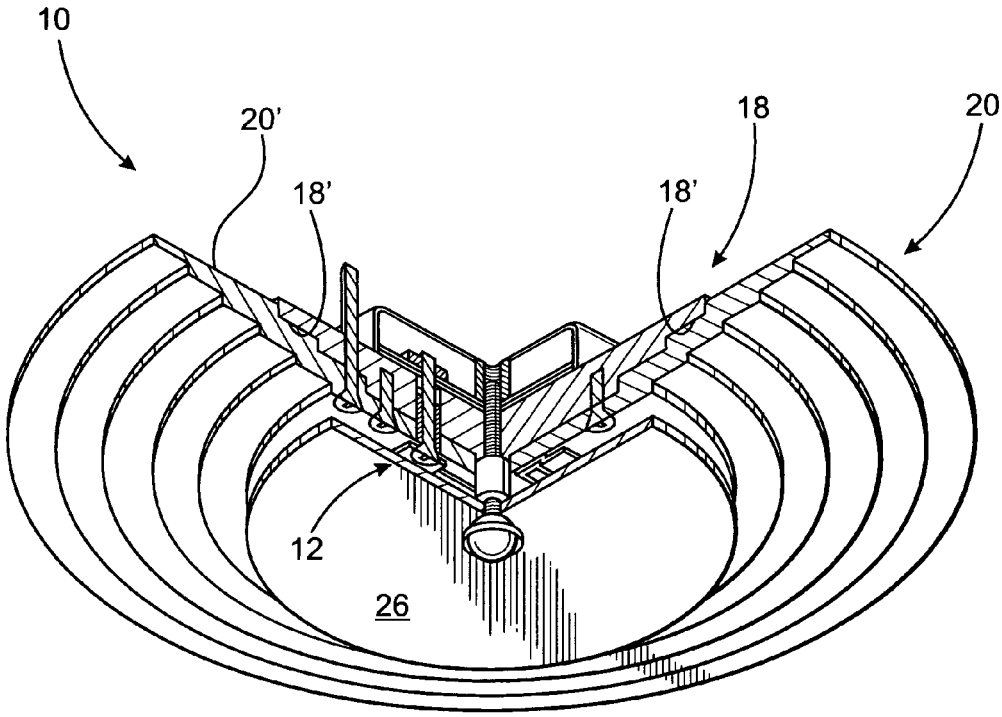
FIG. 3 is a bottom perspective view in partial cutaway showing details of the embodiment of FIGS. 1 and 2.
Figure 4:
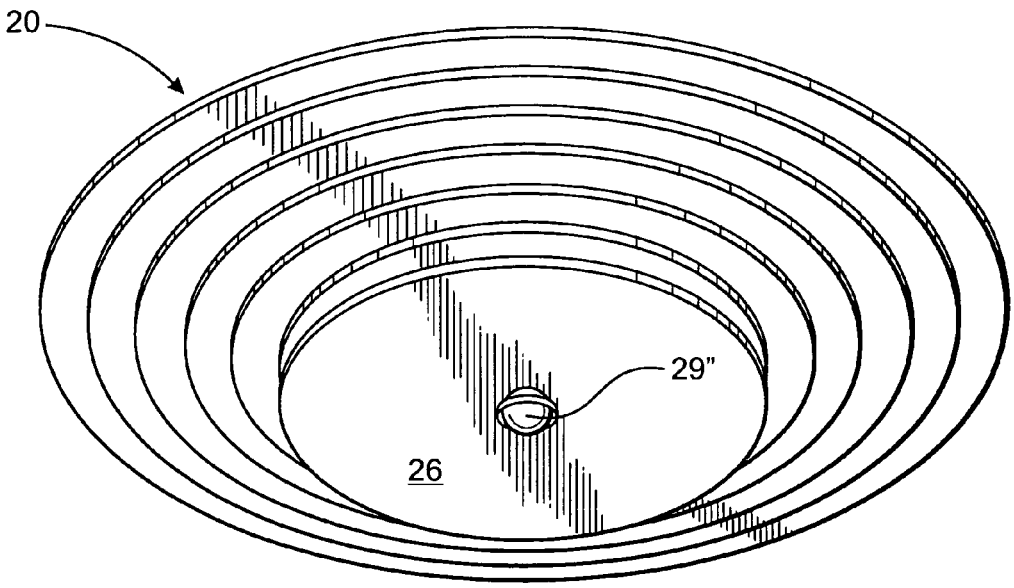
FIG. 4 is a bottom perspective view of the embodiment of FIGS. 1 through 3.
Figure 5:
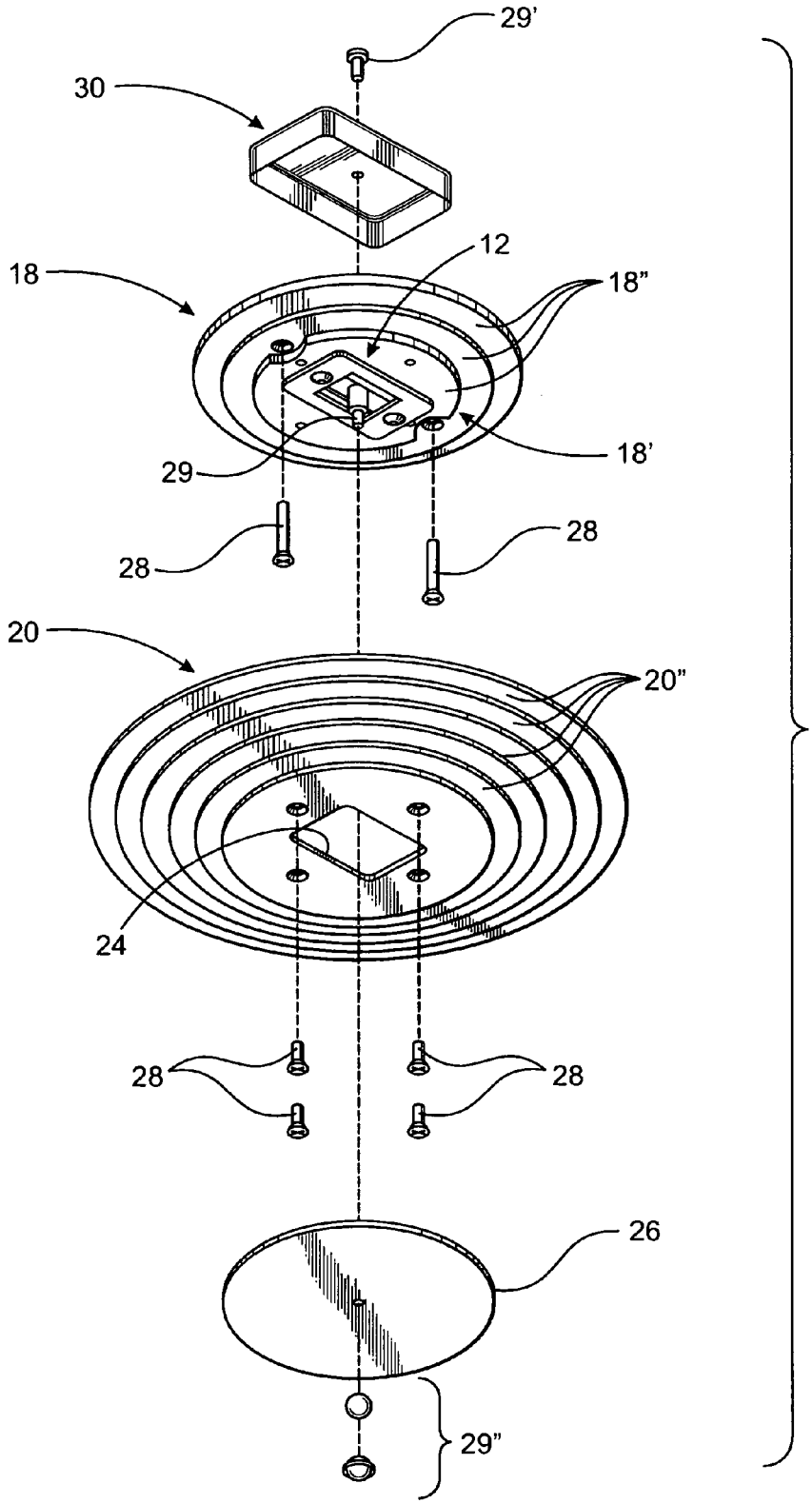
FIG. 5 is an exploded perspective view of the various operative and structural components associated with the embodiments of FIGS. 1 through 4.

Interconnection of the various components into the assembled orientation of FIGS. 3 and 4 may be accomplished by a plurality of generally conventional connectors as at 28 and a decorative or utilitarian attachment assembly 29, 29', 29", etc. Further, a housing, enclosure, junction box or like structure 30 is provided for the housing of wiring, conductors and other electrical components. Housing 30 is connected to the under surface or rear portion of the mounting assembly 18 and may further include supportive backing plates or the like as at 32 and 32'. These backing plates 32, 32' facilitate the interconnection and support of a remainder of the light fixture assembly 10 when it is attached to or supported by ceiling, wall or other supporting surface or structure. Moreover, as schematically represented in FIG. 1, the electrical components or conductors stored within the housing or junction box 30 are schematically represented as at 33. Further, an electrical interconnection to an appropriate source of electrical energy is also schematically represented as at 34 in FIGS. 1, 7 and 9.

Yet another preferred embodiment of the light fixture assembly 10 of the present invention is represented primarily but not exclusively in FIGS. 6 through 10. As set forth above with regard to the detailed description of the structural features associated with FIGS. 1 through 5, the heat sink structure which facilitates the dissipation of heat from the illumination assembly 12 is defined, at least in part, by the mounting assembly 18 being disposed in heat transferring relation with the illumination assembly 12 and the cover structure 20 being disposed in substantially continuous, confronting engagement with the mounting assembly 18 along the correspondingly positioned surfaces 18' and 20'. As such, heat is transferred from the illumination assembly 12 through the mounting assembly 18 and to the cover structure 20 for eventual dissipation to the surrounding area. In accomplishing such an efficient heat transfer, both the mounting assembly 18 and the cover structure 20 are formed of a conductive material such as, but not limited to, a metallic material. The metallic material of which the mounting assembly 18 and the cover structure 20 are formed are also typically capable of conducting electrical current. Therefore, the additional preferred embodiment of FIGS. 6 through 10 is directed towards structural features which eliminate or significantly reduce the possibility of any type of electrical conductor or electrical components coming into direct contact with the mounting assembly 18 and/or the cover structure 20.

Figure 9:
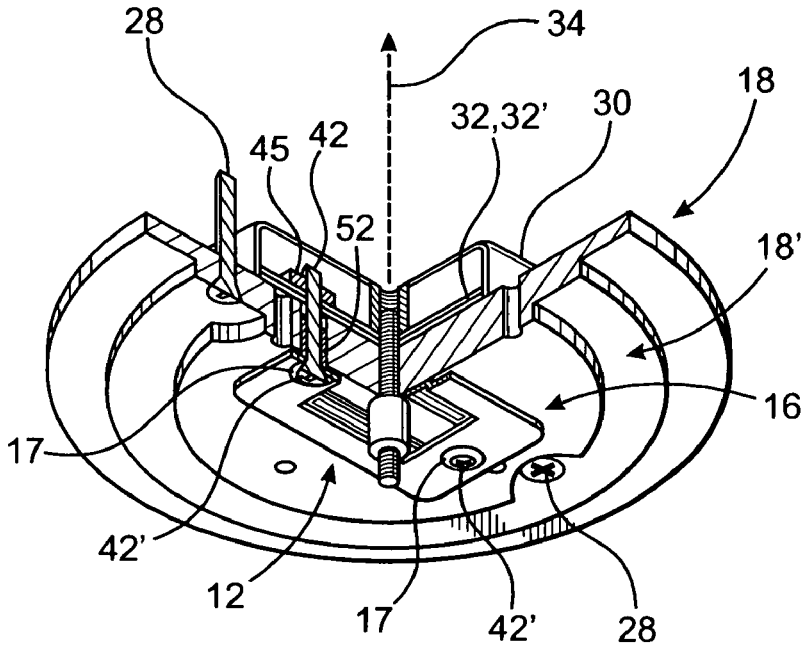
FIG. 9 is a bottom perspective view in partial cutaway showing details of the embodiment of FIGS. 6 through 8.
Figure 10:
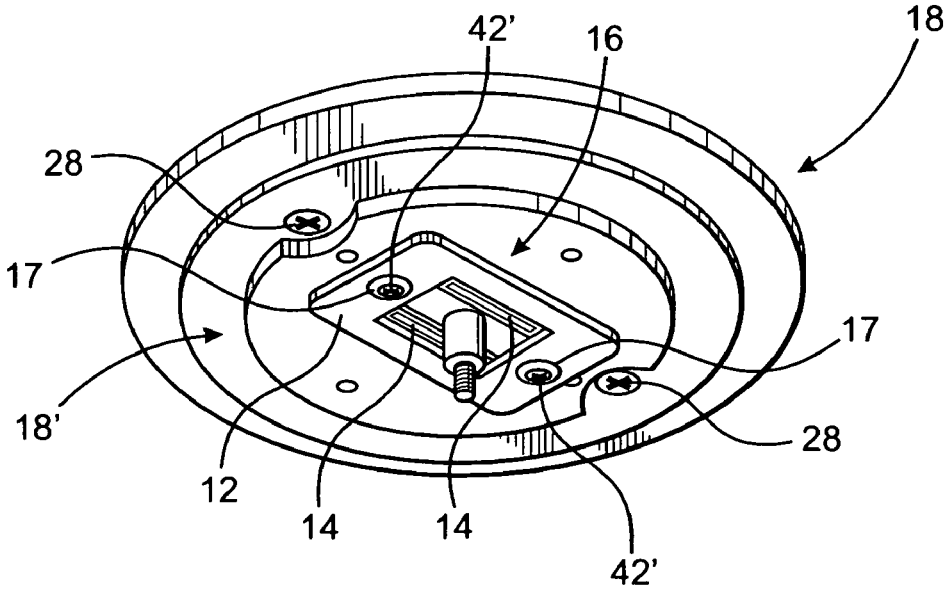
FIG. 10 is a bottom perspective view of the embodiment of FIGS. 6 through 9.

However, it is important that current flow is effectively directed to the illumination assembly 12 specifically including the control circuitry 16 to regulate the activation and operation of the one or more light emitting diodes 14. Therefore, the light fixture assembly 10 further includes a conductor assembly generally indicated as 40 in FIG. 6, which is disposed in interconnecting, current conducting relation between the illumination assembly 12 and an appropriate source of electrical energy as schematically represented in FIGS. 1, 7 and 9 as 34.

More specifically, the conductor assembly 40 is more specifically defined as at least one, but more practically a plurality of connectors 42. Each of the one or more connectors 42 is in the form of sufficiently dimensioned and configured connector structure formed of a conductive material. Moreover the one or more connectors 42 are disposed in mechanically interconnecting relation between the illumination assembly 12 and the mounting assembly 18.

As such, when the one or more connectors 42 are in their interconnected disposition, as represented in FIGS. 7 through 10, they will mechanically connect the illumination assembly 12, and more specifically the printed circuit structure 16 with the mounting assembly 18. This interconnection may be accurately referred to as an "assembled orientation". Accordingly, the one or more conductive material connectors 42, when interconnecting the printed circuit structure 16' of the illumination assembly 12 to and/or with the mounting assembly 18, will establish a path of electrical current flow from the source of electrical energy 34, to the control circuitry 16 and the one or more LEDs 14. As such, appropriately disposed and structured conductors interconnect the one or more connectors 42 with the source of electrical energy 34. However, the specific wiring configurations which serve to interconnect the source of electrical energy 34 and the conductive material connectors 42 may take many forms and is therefore not shown, for purposes of clarity.

In addition, each of the one or more connectors 42 defining at least a part of the conductor assembly 40 are also specifically structured, such as about the head portions 42' thereof. These head portions 42' engage a conductive portion 17 of the printed circuit structure 16' such that electrical current flow will pass effectively through the control circuitry 16 to the one or more LEDs 14 in order to regulate and control activation and operation of the LEDs 14, as set forth above. Interconnecting disposition of the one or more connectors 42 with the illumination assembly 12 and the mounting assembly 18 is accomplished by the one or more connectors 42 passing through the body of the mounting assembly 18 by virtue of appropriately disposed and dimensioned apertures 44 formed in the mounting assembly 18. Securement of the connectors 42 in their interconnecting position, which defines the assembled orientation of the illumination assembly 12 of the mounting assembly 18, is further facilitated by the provision of connecting nuts or like cooperative connecting members 45 secured to a free end of the one or more connectors 42 represented in FIGS. 6 and 9.

As described, the one or more connectors 42, being formed of a conductive material, serve to establish an electrical connection and an efficient electrical current flow from the source of electrical energy 34 to the printed circuit structure 16' of the control circuitry 16. However, due to the fact that the mounting assembly 18 is also formed of a conductive material such as, but not limited to a metallic material, it is important that the one or more connectors 42 will be electrically isolated or segregated from contact with the mounting assembly 18 as they pass through the corresponding apertures 44 in the mounting assembly 18. Accordingly, this preferred embodiment of the light fixture assembly 10 of the present invention further comprises an insulation assembly 50. The insulation assembly 50 is formed of a non-conductive material and is disposed in isolating, segregating position between the one or more connectors 42 and the mounting assembly 18.

Figure 6:
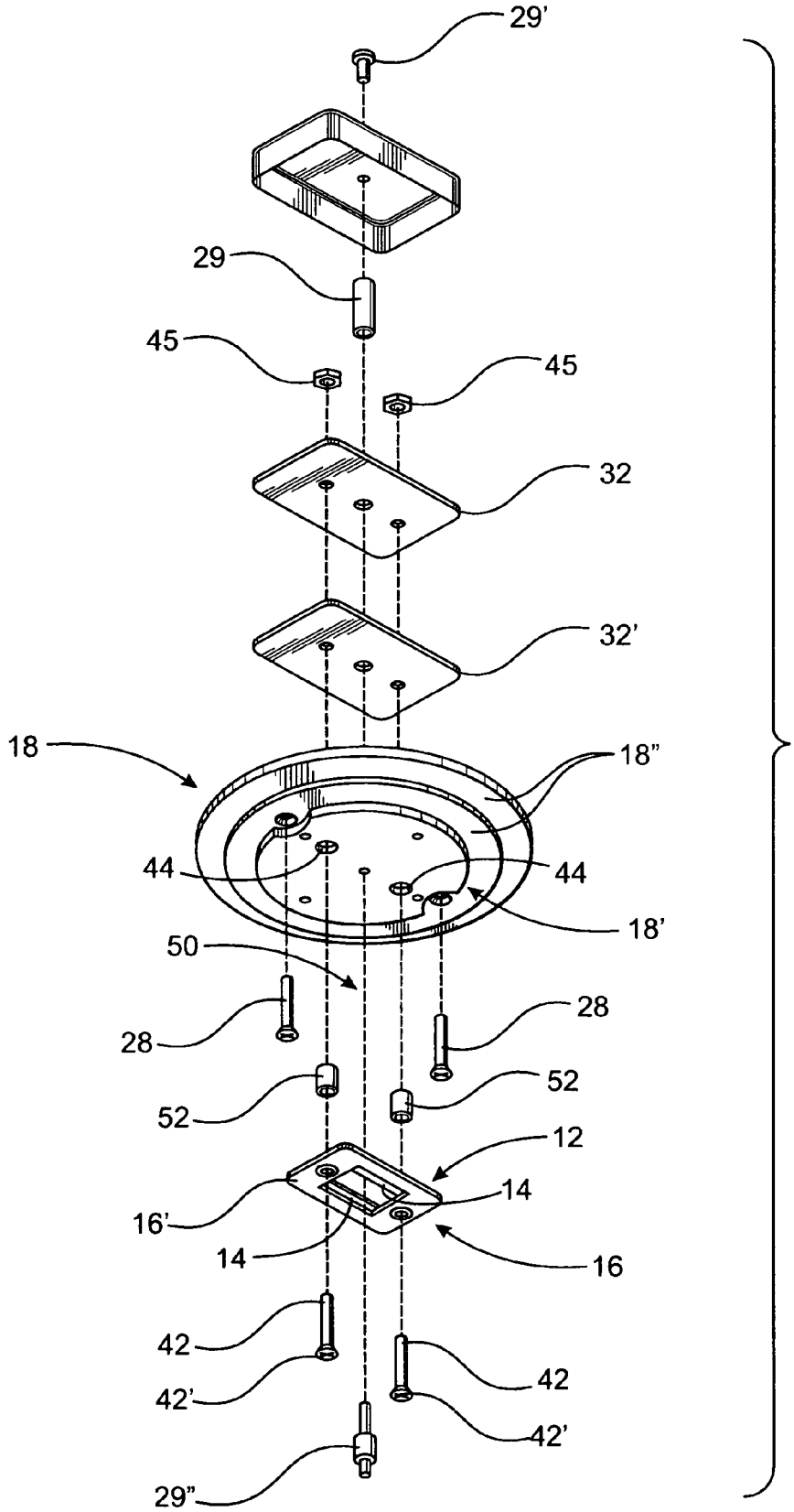
FIG. 6 is an exploded perspective view of a portion of the embodiments of FIGS. 1 through 5.
Figure 7:
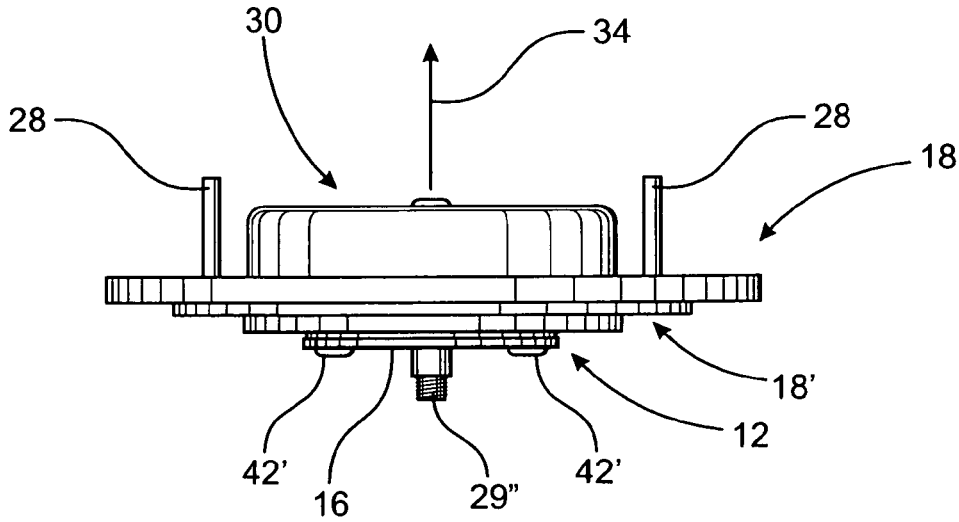
FIG. 7 is a side view of the embodiment of FIG. 6.
Figure 8:
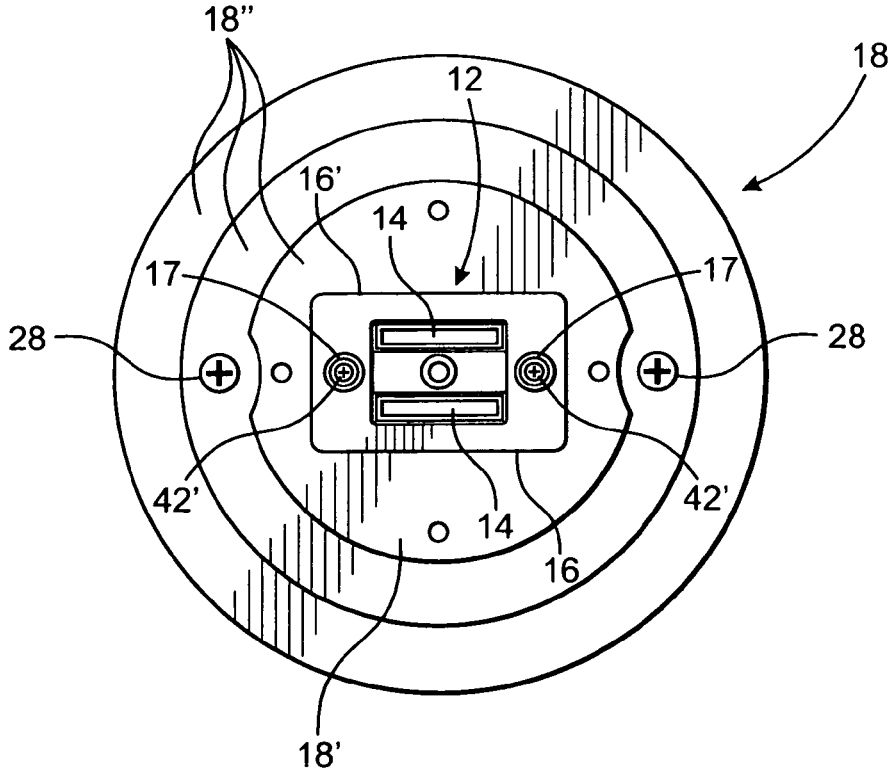
FIG. 8 is a bottom view of the embodiment of FIGS. 6 and 7.

With primary reference to FIGS. 6 and 9, the insulation assembly 50 comprises at least one but more practically a plurality of non-conductive material bushings 52 at least in equal in number to the number of conductive material connectors 42. Therefore, when the illumination assembly 12 and the mounting assembly 18 are in the assembled orientation as represented in FIGS. 7 through 10, the non-conductive material bushings 52 are connected to or mounted on the mounting assembly 18 by being disposed at least partially on the interior of the apertures 44. As such, the bushings 52 are disposed in surrounding, isolating, segregating relation to the conductive material connectors 42 so as to prevent contact between the connectors 42 and the mounting assembly 18. Therefore, because the bushings 52 effectively isolate or segregate each of the one or more connectors 42 from direct contact with the mounting assembly 18, any type of short-circuit will be eliminated or significantly reduced.

Therefore, the light fixture assembly 10 comprising both the aforementioned conductor assembly 40 and the cooperatively disposed and structured insulation assembly 50 facilitates the mounting assembly being disposed, when in the assembled orientation of FIGS. 7 through 10, in electrically isolated or segregated relation to the conductor assembly 40. Concurrently, the mounting assembly 18 is still disposed in heat dissipating relation to the illumination assembly 12 and the cover structure 20, wherein efficient removal or transfer of heat from the illumination assembly 12 is further facilitated, as described in detail above.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A light fixture assembly having heat dissipating capabilities, said light fixture assembly comprising:

an illumination assembly, a mounting assembly disposed in supporting engagement with said illumination assembly, said mounting assembly formed of a heat conductive material and disposed in heat transferring engagement with said illumination assembly, said mounting assembly structured to dissipate heat from said illumination assembly, a cover structure formed of a heat conductive material and connected in heat transferring engagement with said mounting assembly, said cover structure disposed and structured to dissipate heat from said mounting assembly, correspondingly positioned surfaces of said mounting assembly and said cover structure disposed in substantially continuously confronting and heat transferring engagement with one another over a majority of said mounting assembly, said illumination assembly disposed in direct confronting, heat transferring engagement with said correspondingly positioned surface of said mounting assembly, said heat conductive material of each of said cover structure and said mounting assembly being sufficiently heat conductive to collectively define a heat sink, and said cover structure and said mounting assembly defining said heat sink being disposed and structured to collectively dissipate heat away from said illumination assembly, and said illumination assembly and said cover structure relatively disposed and cooperatively structured to direct light outwardly from an exposed, outer surface of said cover structure.

2. A light fixture assembly as recited in claim 1 wherein said correspondingly positioned surfaces of said mounting assembly and said cover structure are correspondingly configured to facilitate said substantially continuous confronting engagement with one another.

3. A light fixture assembly as recited in claim 2 wherein said correspondingly positioned surface of said mounting assembly comprises a smaller transverse dimension than that of said cover structure, said mounting assembly and said cover structure each including a stepped configuration extending over at least a majority of said smaller transverse dimension of said mounting structure, said stepped configurations of said cover structure and said mounting assembly being correspondingly disposed and dimensioned for mating engagement with one another.

4. A light fixture assembly as recited in claim 1 wherein said stepped configuration of said mounting assembly and said cover structure each comprise a plurality of annular steps concentrically disposed relative to one another, each of said plurality of annular steps extending along at least said smaller transverse dimension of said mounting assembly.

5. A light fixture assembly as recited in claim 4 wherein each of said plurality of annular steps of said mounting assembly and said cover structure are disposed in concentrically surrounding relation to said illumination assembly.

6. A light fixture assembly as recited in claim 5 wherein respective ones of said plurality of annular steps of said mounting assembly and said cover structure are disposed in non-planar relation to one another.

7. A light fixture assembly as recited in claim 1 wherein said mounting assembly comprises a plate-like configuration defining a mounting plate, said illuminating assembly, said mounting plate and said cover structure are connected in substantially parallel, co-axial relation to one another.

8. A light fixture assembly as recited in claim 7 wherein said cover structure comprises an outer periphery disposed in outwardly spaced, substantially surrounding relation to said mounting plate.

9. A light fixture assembly as recited in claim 7 wherein said illumination assembly is substantially centrally disposed on said mounting assembly in surrounded relation by an outer periphery of said mounting plate.

10. A light fixture assembly as recited in claim 9 wherein said cover structure is disposed in substantially co-axial relation to said mounting plate and includes an outer peripheral edge disposed radially outward in spaced, surrounding relation to said outer periphery of said mounting assembly.

11. A light fixture assembly as recited in claim 7 wherein said illumination assembly and said cover structure are relatively disposed and cooperatively structured to direct light outwardly from an exposed, outer surface of said cover structure.

12. A light fixture assembly as recited in claim 7 wherein said cover structure comprises an apertured construction including at least one aperture disposed in substantially aligned, receiving relation with said illumination assembly.

13. A light fixture assembly as recited in claim 12 wherein said one aperture is further disposed and dimensioned to facilitate disposition of said illumination assembly within said one aperture and passage of light outwardly from an exposed surface of said cover structure.

14. A light fixture assembly having heat dissipating capabilities, said light fixture assembly comprising:

an illumination assembly, a mounting assembly connected in supporting engagement with said illumination assembly, said mounting assembly formed of a heat conductive material and disposed in heat transferring engagement with said illumination assembly, said mounting assembly structured to dissipate heat from said illumination assembly, a cover structure formed of a heat conductive material and connected in confronting heat transferring engagement with said mounting assembly, said cover structure disposed and structured to dissipate heat from said mounting assembly, correspondingly positioned surfaces of said mounting assembly and said cover structure being correspondingly configured and disposed in mating relation with one another, said heat conductive material of each of said cover structure and said mounting assembly being sufficiently heat conductive to collectively define a heat sink, said cover assembly and said mounting assembly defining said heat sink collectively disposed and structured to dissipate heat from said illumination assembly, said mating relation of said correspondingly positioned surfaces being defined by a continuous confronting engagement with one another over a least a majority of said corresponding surface of said mounting assembly, said illumination assembly disposed in direct confronting, heat transferring engagement with said correspondingly positioned surface of said mounting assembly, and said illumination assembly, said mounting assembly and said cover structure relatively disposed to facilitate a passage of light from said illumination assembly outwardly from an exteriorly disposed surface of said cover structure.

15. A light fixture assembly as recited in claim 14 wherein said exteriorly disposed surface of said cover structure is oppositely disposed relative to said correspondingly positioned surface of said cover structure.

16. A light fixture assembly as recited in claim 14 wherein said mounting assembly comprising a plate-like configuration defining a mounting plate, said mounting plate comprising a smaller transverse dimension than said cover structure.

17. A light fixture assembly as recited in claim 16 wherein said correspondingly positioned surfaces of said mounting plate and said cover structure each include a stepped configuration extending over at least a majority of said transverse dimension of said mounting plate correspondingly disposed and dimensioned to facilitate said mating relation with one another.

18. A light fixture assembly as recited in claim 17 wherein said stepped configuration of said mounting plate and said cover structure each comprise a plurality of annular steps concentrically disposed relative to one another each of said plurality of annular steps of said mounting plate and said cover structure being disposed in a radially outward, concentrically surrounding relation to said illumination assembly and in non-planar relation to one another.

19. A light fixture assembly as recited in claim 14 wherein said cover structure comprises an apertured construction including at least one aperture disposed in substantially aligned receiving relation with said illumination assembly.

20. A light fixture assembly as recited in claim 19 wherein said one aperture is further disposed and dimensioned to facilitate passage of light outwardly from an exposed, outer surface of said cover structure.

21. A light fixture assembly as recited in claim 14 wherein said illumination assembly comprises at least one LED disposed in heat transferring relation to said mounting assembly.

22. A light fixture assembly as recited in claim 14 wherein said illumination assembly comprises a plurality of LEDs each disposed in heat transferring relation to said mounting assembly.

* * * * *